US005187323A

United States Patent [19]

Saxby

[11] Patent Number: 5,187,323

[45] Date of Patent: Feb. 16, 1993

[54] PRESSURIZED GAS CARTRIDGE AMMUNITION

[76] Inventor: Michael E. Saxby, Beresteinseweg 26, 1217 TJ Hilversum, Netherlands

[21] Appl. No.: 836,122

[22] Filed: Feb. 14, 1992

[30] Foreign Application Priority Data

Feb. 14, 1991 [NL] Netherlands ..... 9100257

[51] Int. Cl.[5] ..... F42B 5/02

[52] U.S. Cl. ..... 102/440; 223/3; 124/73; 124/74

[58] Field of Search ..... 222/3; 102/430, 440; 124/57, 71, 73, 74, 75

[56] References Cited

U.S. PATENT DOCUMENTS 4,539,969 2/1985 Saxby ..... 102/440
4,601,278 7/1986 Kim ..... 102/440
4,697,523 10/1987 Saxby ..... 102/440

FOREIGN PATENT DOCUMENTS 2124346 2/1984 United Kingdom ..... 102/440

*Primary Examiner*—Harold J. Tudor
*Attorney, Agent, or Firm*—Thomas R. Vigil; James P. Hanrath

[57] ABSTRACT

In a cartridge casing there is provided a telescopic valve stem having at its forward end a main outlet valve and at its rearward end a servo- or pressure relief valve, a piston-like collar on the forward part of the valve stem divides the interior of the casing into a forward main chamber and a rearward auxiliary chamber; the chambers are connected by a bleeding passage and have an outlet opening at the forward end and the rearward end of the casing respectively, which openings are normally closed by the respective valves. A chamber of variable volume within the telescopic valve stem is in communication with the atmosphere, due to which the rearward or servo-valve may be opened by a slight fire pin blow to initiate the discharge of pressurized gas filling from the main chamber.

5 Claims, 2 Drawing Sheets

PRESSURIZED GAS CARTRIDGE AMMUNITION

The invention relates to a pressurized gas cartridge ammunition, comprising a casing defining a gas pressure chamber, said casing having a bottom with a rear passage for pressure relief and fire pin actuation, and a front end piece with a main discharge opening, an axially guided valve stem within said casing, a valve body provided at the forward end of said stem which normally closes the main discharging opening and a valve body provided at the rearward end of said valve stem which normally closes said relief passage and is adapted to be actuated through said passage, said valve stem being telescopingly extendable and comprising a forward part with a piston-like head portion at its rearward end, which divides said gas pressure chamber into a main chamber merging into the main discharge opening and an auxiliary chamber merging into the rearward relief passage, a rearward part of said valve stem having a cylindrical portion which is mounted for sliding—against spring action—into a corresponding bore in the head portion of the forward valve stem part, thereby providing a central chamber of variable volume within the telescoping valve stem, whereas a bleeding passage is provided between said main and said auxiliary chambers.

Such a pressurized gas ammunition is known from GB 2124346 (see in particular the embodiment represented in FIGS. 9 and 10).

In this well-known cartridge the central chamber within the telescoping valve stem is connected with the main discharge chamber through a radial bore in the respective wall portion of the forward valve stem part, whereas the bleeding passage connection between the main and auxiliary chambers is formed by the clearance between the cylindrical portion of the rearward valve stem part and the corresponding bore in the piston-like head of the forward valve stem part.

As a consequence of this the central chamber within the telescoping valve stem is under the full gas pressure, which may be as high as 400 bar.

This creates a rather substantial closing force on the rearward valve body. Consequently a relatively high firing pin pressure is required to open said rearward valve body and thereby initiate the main discharge of the air pressure filling.

In practice it has been found that a high firing pin pressure leads to rapid wear of and damage to the mechanism of the gun in which the cartridge is used. Moreover the rearward valve body tends to close before the auxiliary chamber is adequately relieved and this usually leads to an incomplete discharge of the main gas filling as well.

It is therefore an objective of the present invention to provide an improved pressurized gas cartridge ammunition of the type above referred to, which requires a relatively low firing pin pressure to be operated and still provides for adequate sealing of the cartridge in the storage (under pressure) condition.

In accordance with the invention this objective is achieved in that the bleeding passage is formed radially outwardly with respect to the central chamber within the telescoping valve stem, whereas the cylindrical portion of the rearward valve stem part is sealingly engaging the corresponding bore of said piston-like head portion and said central chamber is vented through a passage extending axially through the valve stem.

It will be appreciated that in the cartridge of the invention the pressure in the central chamber of the telescoping valve stem will be atmospheric and consequently permits the rearward valve body to be opened very fast due to a relatively low firing pin actuating force, whereas it will remain open long enough to completely discharge the auxiliary chamber and thereby creating optimum conditions for a complete discharge of the main gas chamber. It will also be clear that due to the bleeding connection being provided radially outwardly with respect to the bore in the piston-like head portion, e.g. between the piston-like head and the wall of the gas pressure chamber, sealing rings of a substantially smaller diameter may be used; this reduces the resistance to axial displacements of the valve stem portions quite substantially and creates more favorable conditions for urging the valve stem portions to return to the closed position upon unloading of the gas pressure chamber.

The invention will be hereinafter further explained by way of example with reference to the accompanying drawings.

Figure 2:
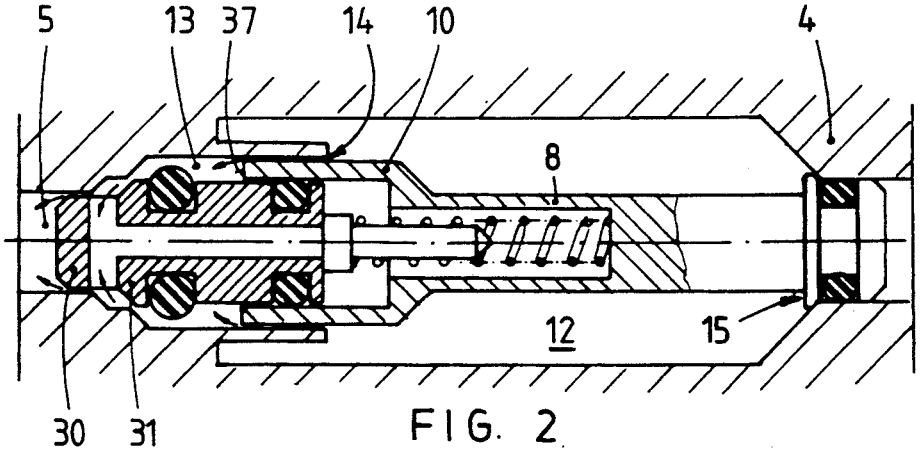
FIG. 2 shows the cartridge ammunition of FIG. 1 in a position, in which the rearward valve stem part is being actuated by a fire pin of a gun so as to release pressurized air from the auxiliary chamber and prepare for opening of the main discharge valve.
Figure 3:
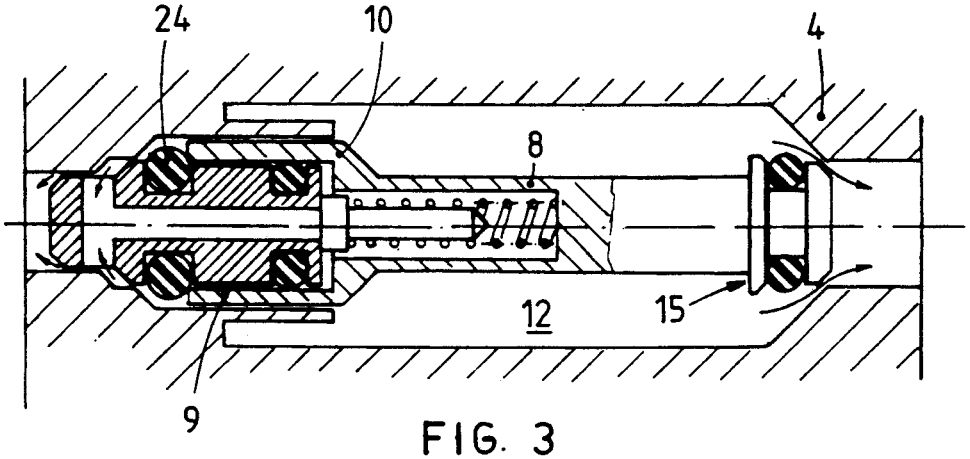
Figure 4:
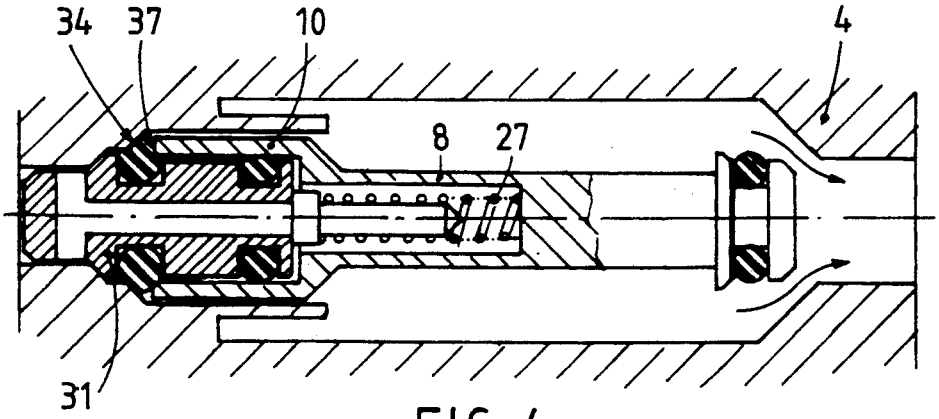

FIG. 3 shows the cartridge ammunition of FIG. 2 in a subsequent stage in which the forward or main discharge valve is being opened to discharge the pressurized gas from the main chamber; and FIG. 4 shows the ammunition of FIG. 3 in a position in which the forward valve stem portion with the main discharge valve is in its fully opened position, while the rearward valve stem portion with the rearward valve has returned to its closed position.

The cartridge 1 shown in the drawings comprises a hollow casing 2 with a threadingly inserted bottom piece 3 and a front end portion 4 which is designed for threadingly engaging a retaining means for holding a missile (not shown).

The bottom piece 3 has a rearward passage 5 for initial pressure relief and for fire pin actuation as will be explained hereinafter in more detail.

A main discharge opening 6 is provided in the front end portion 4.

A telescoping valve stem 7 is provided within the casing 2 and comprises a forward valve stem part 8 and a rearward valve stem part 9.

A piston-like head 10 is provided at the rear end of the forward valve stem part 8 and is slidingly engaging a corresponding cylindrical bore 11 in the bottom piece 3. The piston-like head 10 divides the space within the hollow casing 2 into a front or main gas pressure chamber 12 and a rear or auxiliary gas pressure chamber 13, the latter being located within the bore 11 and surrounding the rearward valve stem part 9.

The main discharge chamber 12 merges into the front or main discharge passage 6, whereas the auxiliary chamber 13 merges into the relief passage 5. Between the two chambers 12 and 13 there is a bleeding passage connection 14 which is formed by the circumferential clearance between the bore 11 and the piston-like head 10.

A main discharge valve body 15 is provided at the front end of the forward valve stem part 8 and normally closes the main discharge passage 6. The valve body 15 comprises a sealing ring 16 of the O-ring type seated between two collar portions 17 and 18 and adapted to sealingly engage the cylindrical wall of the passage 6.

The rearward collar portion 18 has a frusto-conically shaped front face so as to closingly engage the corresponding conical end wall 19 of the front end portion 4. The front collar portion 17 is a clearance fit within the passage 6.

The rearward valve stem part 9 is substantially formed by a cylindrical spool member comprising relatively narrow front and rear land portions 20 and respectively 22 and a relatively wide middle land portion 21 therebetween. O-rings 23 and 24 are provided in the grooves between front and middle land portions 20, 21 and between middle and rear land portions 21, 22 respectively.

The spool member 9 is mounted with its front and middle land portions 20 and 21 for sliding in a corresponding bore 25 in the piston-like head 10, whereby O-ring 23 is sealingly engaging said bore.

A stem portion 30 provided at the rear end of the spool member 9 extends—with substantial clearance—axially into the cylindrical pressure relief passage 5. The transition between the cylindrical stem portion 30 and the rear cylindrical land portion 22 is formed by a frusto-conical portion 31, which is fact constitutes the rearward valve body and is adapted to normally close the relief passage 5 and for that purpose cooperates with a corresponding conical seat 32 formed around the opening end of the relief passage 5.

A relatively short cylindrical wall portion 33 extends from the seat 32 axially forwardly to accommodate the rear land portion 22 and is adapted to be sealingly engaged by the O-ring 24 in the closed position of the spool and valve member 9. The transition between the cylindrical wall portion 33 and the cylindrical bore 11 is formed by a connecting conical wall portion 34. The diameter of the cylindrical wall portion 33 is slightly larger than that of the bore 25.

The bore 25 constitutes a central vent chamber 26, which is forwardly extended by a bore **25*a* of smaller diameter. A return spring 27 is provided within the central chamber 26, 25*a***.

The front end of the spring 27 engages the bottom end **25*b* of the bore 25*a*, whereas the rear end of the spring engages the head 29 of a centering pen 28 that extends axially from the front end face of the spool member 9**.

A vent passage 35 extends rearwardly from the front end face of the spool member 9 and merges into the relief passage 5 at 36 at the circumference of the stem portion 30.

Figure 1:
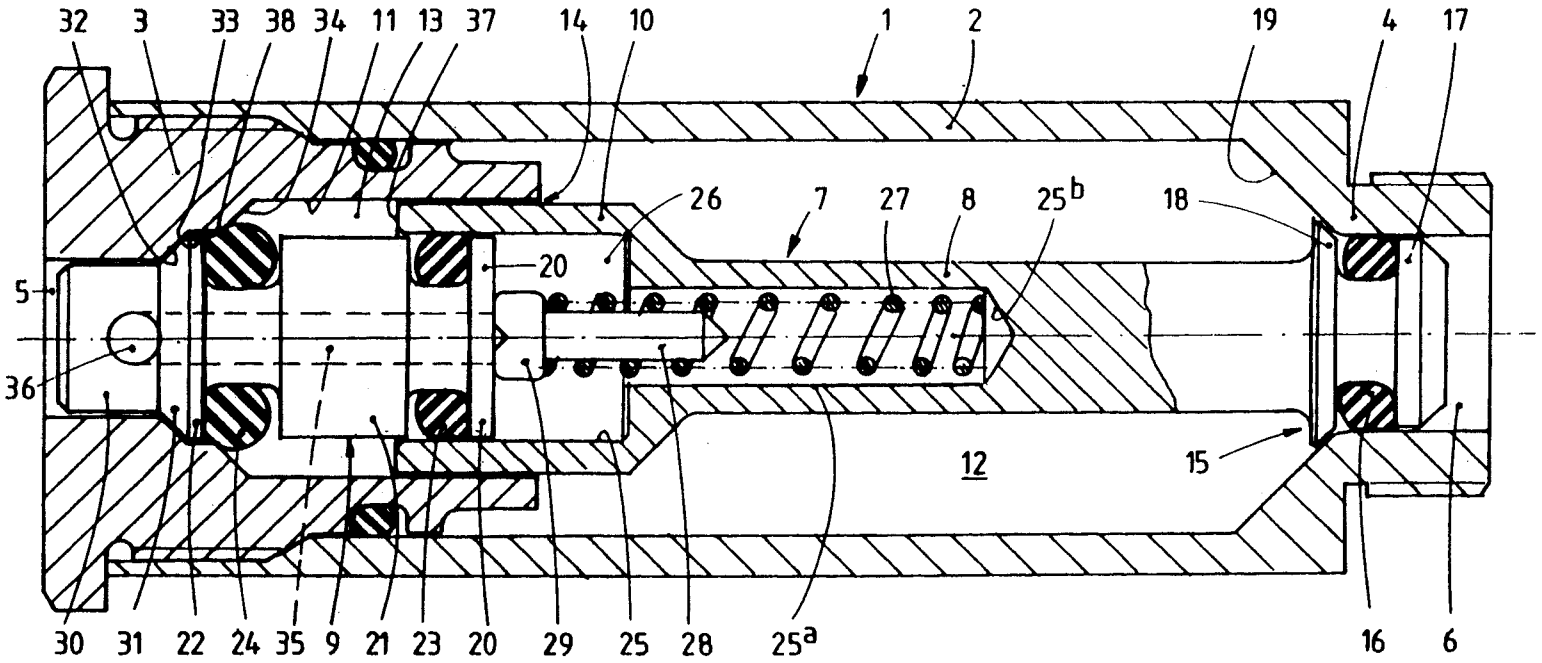
FIG. 1 shows a longitudinal section of a pressurized gas cartridge ammunition according to the present invention on an enlarged scale of 10:1.

FIG. 1 shows the cartridge in the fully closed position, wherein both the main discharge passage 6 and the rear relief passage 5 are closed by the valve bodies 15 and 31 respectively at the front and rear ends of the valve stem 7. Assuming the cartridge is empty, it is the relatively weak return spring 27 that holds the valve stem 7 in its extended position.

For charging with gas, e.g. compressed air, the cartridge may be connected with its threaded front end piece 4 to a charging apparatus (not shown). By means of such apparatus pressurized air may be supplied through the main discharge passage 6 to urge the forward valve stem part 8 with its main discharge valve 15 backwards against the action of the return spring 27 into the opened position so as to fill the main gas pressure chamber 12. During filling pressurized air is flowing from the chamber 12 through the bleeding passage 14 into the auxiliary chamber 13 and this bleeding flow will continue after completion of the charging process until the gas pressure in chamber 13 has become equal to that in chamber 12.

Assuming the inner diameter of discharge passage 6 corresponds with that of the bore 25, the main discharge valve 15 will now be firmly held in its closed position due to the full air pressure acting on the rear annular face 37 of the piston-like head 10.

Apart from the relatively low bias of the return spring 27, the spool member 9 with its relief valve body 31 is now kept closed under the action of the air pressure within the auxiliary chamber 13 due to a slight difference in diameter between the short cylindrical wall portion 33 and the bore 25. As shown in FIG. 1 the rear O-ring 24 is slightly oversized, so that it extends laterally beyond the circumferential surface of the spool member 9 and tends to bend around the transitional edge 38 between cylindrical wall portion 33 and conical wall portion 34. The latter feature not only secures excellent sealing under a rather limited closing force acting on the relief valve body, but also provides for a shock absorbing facility as will be hereinafter further explained.

Turning now to FIGS. 2–4, the operation of the cartridge is as follows:

FIG. 2 represents the cartridge on the moment, on which a firepin (not shown) is excerting (or has just been excerting) a blow on the rear end of the stem portion 30, which has resulted in a rapid opening of the relief valve 31, thereby initiating a quick release of pressurized air from the auxiliary chamber 13 through the relief passage 5. During pressure release overatmospheric pressure is acting on the conical rear face 32 of the valve body 31, which causes said valve body to remain open until the pressure release has been completed. Immediately after initiation of the pressure release pressurized air will start flowing from the main gas pressure chamber 12 into the chamber 13 through bleeding passage 14. The bleeding air rate, however, is neglectable in comparison with the relief flow through the open relief valve. Also immediately upon initiation of the pressure relief the forward valve stem part 8 starts moving backwards due to the "sudden" decrease of the air pressure acting on the rear annular face 37. So in FIG. 2 the forward stem part carrying the main discharge valve 15 is about to move backwards and thereby moving the valve 15 into the open position.

FIG. 3 represents the stage, wherein the forward valve stem part 8 is approaching its rearward position, while the main discharge valve 15 has been opened to a substantial degree so as to cause a quick discharge of the pressurized gas from the main gas pressure chamber 1 in an "explosive" manner. In the stage shown in FIG. 3, the piston-like head 10 of the forward valve stem portion 8 has come into engagement with the outer circumferential part of the rear O-ring 24 that extends laterally beyond the circumferential surface of the spool member 9. Starting from the stage represented in FIG. 3, the forward valve stem part 8 will continue its rearward movement, thereby causing the spool member 9 with its rear valve body 31 to move in the closing direction.

Finally FIG. 4 represents the moment on which the relief valve body 31 has reached its closed position and on which the forward valve stem portion 8 has come to a stand still. It will be appreciated that during the last stage of the rearward movement of the forward valve stem portion 9 the rear O-ring 24 is functioning as a shock absorbing abutment for the piston-like head 10, which prevents said head from beating with its rear end face 37 against the conical end wall portion 34.

It will be appreciated that FIGS. 2–4 represent intermediary stages of a pressurized gas discharge process which in reality is taking place in a fraction of a second.

In practical use the pressurized gas filling discharge in FIGS. 3 and 4 may be used for the propulsion of a missile which is held in a retaining means screwed on the threaded front end piece 4 in a well-known manner.

After having reached its rearward end position shown in FIG. 4 the forward valve stem part 8 is caused by the return spring 27 to return to its closed position represented in FIG. 1, in which recharging of the cartridge may take place from either end of the cartridge.

I claim:

1. A pressurized gas cartridge ammunition, comprising a casing defining a gas pressure chamber, said casing having a bottom with a rear passage for pressure relief and fire pin actuation, and a front end piece with a main discharge opening, an axially guided valve stem within said casing, a valve body provided at the forward end of said stem which normally closes the main discharge opening and a valve body provided at the rearward end of said stem which normally closes said relief passage and is adapted to be actuated through said passage, said valve stem being telescopingly extendable under the action of reset spring means and comprising a forward part carrying a piston at its rearward end, which divides said gas pressure chamber into a forward main chamber surrounding said forward valve stem part and merging into the main discharge opening and a rearward auxiliary chamber merging into said rear relief passage, a rearward part of said valve stem having a cylindrical portion which is mounted for sliding against said reset spring means into a corresponding bore in the piston of the forward valve stem part, thereby providing a central chamber of variable volume within the telescoping valve stem, a bleeding passage being provided between said main and said auxiliary chambers, characterized in that said bleeding passage (14) is formed by the clearance that is determined by the sliding fit between the piston (10) and a wall (11) of the gas pressure chamber in said casing (2), whereas the cylindrical portion of the rearward valve stem part is provided with sealing means to sealingly engage the corresponding bore of said piston and said central chamber is connected to atmosphere through a passage extending axially through the valve stem.

2. A pressurized gas cartridge ammunition, according to claim 1, characterized in that said cylindrical portion of the rearward valve stem part is formed by a cylindrical spool member (9) which comprises relatively narrow front and rear land portions (20, 22) and a relatively wide middle land portion (21), sealing rings (23, 24) being provided in grooves between said front and middle land portions (20, 21) and said middle and rear land portions (21, 22) respectively, the front sealing ring (23) of which engaging the bore (25) within the piston (10) and the rear sealing ring (24) of which being adapted to sealingly engage a relatively short cylindrical wall portion (33) located radially outwardly from and adjacent said rear relief passage, the rear sealing ring having an effective diameter which is larger than the diameter of the front sealing ring.

3. A pressurized gas cartridge ammunition, according to claim 2, characterized in that an annular closing surface is formed on the back side of said rear land portion (22) adapted to closingly engage corresponding annular seat (32) around said rear relief passage (5).

4. A pressurized gas cartridge ammunition, according to claim 3, characterized in that the rear land portion (21) is connected to a rearwardly extending stem portion (30) of a smaller diameter which is a clearance fit within said rear relief passage (5), whereby said passage (35) connecting said central chamber to atmosphere extends axially through said spool member (9) and opens laterally (at 36) at the circumferential surface of said stem portion (30).

5. A pressurized gas cartridge ammunition according to claim 4, characterized in that the rear sealing ring (24) is extending slightly radially outwardly beyond the circumferential surface of the spool member (9) so as to sealingly engage an annular end wall portion (34) of said auxiliary chamber (13) positioned outwardly and slightly forwardly from said annular seat (32), in addition to the sealing engagement with said cylindrical wall portion (33) which connects said seat (32) and said end wall portion (34).

* * * * *

UNITED STATES PATENT AND TRADEMARK OFFICE

CERTIFICATE OF CORRECTION

PATENT NO. : 5,187,323

DATED : February 16, 1993

INVENTOR(S) : Michael E. Saxby

It is certified that error appears in the above-identified patent and that said Letters Patent is hereby corrected as shown below:

Column 6, line 31, "portion (21)" should be --portion (22)--.

Signed and Sealed this

Eleventh Day of January, 1994

*Attest:*

*Attesting Officer*

Bruce Lehman

BRUCE LEHMAN

*Commissioner of Patents and Trademarks*